US007188618B2

(12) United States Patent
Anschütz et al.

(10) Patent No.: US 7,188,618 B2
(45) Date of Patent: Mar. 13, 2007

(54) OVEN WITH DIMMING LIGHTING SYSTEM

(75) Inventors: Eduard Anschütz, Gaggenau (DE); Sylvia Peter, Kehl (DE); Frank Rödelsperger, Höchst (DE); Bernd Strolz, Baden-Baden (DE); Dieter Weiss, Bühl (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 6 days.

(21) Appl. No.: 10/331,737

(22) Filed: Dec. 30, 2002

(65) Prior Publication Data

US 2003/0131841 A1 Jul. 17, 2003

Related U.S. Application Data

(63) Continuation of application No. PCT/EP01/07175, filed on Jun. 25, 2001.

(30) Foreign Application Priority Data

Jun. 29, 2000 (DE) ..... 100 31 667

(51) Int. Cl.
*F24C 15/00* (2006.01)

(52) U.S. Cl. ..... 126/273 R; 126/19; 126/213; 362/92; 219/220; 219/391; 219/385; 392/416

(58) Field of Classification Search ..... 362/92, 362/94; 126/213, 19 R, 273; 219/758, 220, 219/391, 393, 385, 411; 392/416
See application file for complete search history.

(56) References Cited

U.S. PATENT DOCUMENTS

| | | | | | |
|---|---|---|---|---|---|
| 2,097,977 | A | * | 11/1937 | Hofferbert | 126/19 R |
| 2,164,239 | A | * | 6/1939 | Grayson | 362/94 |
| 2,327,200 | A | * | 8/1943 | Lotter | 362/94 |
| 2,577,541 | A | * | 12/1951 | Resek et al. | 362/94 |
| 2,794,434 | A | * | 6/1957 | Evans | 126/200 |
| 3,231,732 | A | * | 1/1966 | Fersuson et al. | 362/94 |

FOREIGN PATENT DOCUMENTS

| | | |
|---|---|---|
| DE | 196 08 224 A1 | 9/1997 |
| DE | 197 22 044 A1 | 12/1998 |
| DE | 199 06 990 A1 | 8/2000 |
| JP | 359145638 | 8/1984 |
| JP | 03125819 A | 5/1991 |
| JP | 405298540 | 11/1993 |
| WO | WO 00/52392 | 9/2000 |

* cited by examiner

*Primary Examiner*—Carl D. Price
(74) *Attorney, Agent, or Firm*—Russell W. Warnock; Craig J. Loest

(57) ABSTRACT

An oven includes a baking space lighting system switched off automatically after a predetermined period of operation but automatically switched on again upon actuation of a manually actuated oven element.

13 Claims, 1 Drawing Sheet

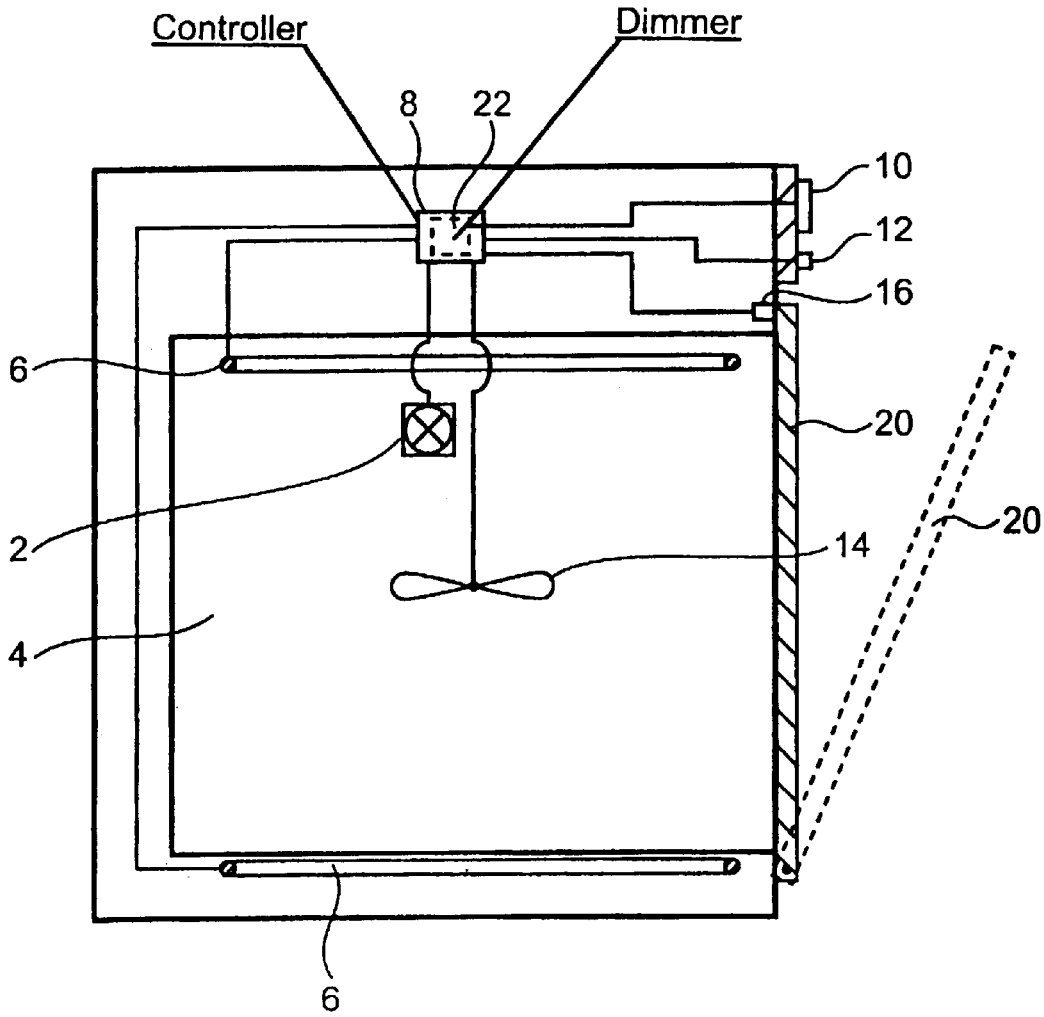
Controller
Dimmer
8
22
10
12
16
6
20
20
2
14
4
6

OVEN WITH DIMMING LIGHTING SYSTEM

CROSS-REFERENCE TO RELATED APPLICATION

This application is a continuation of copending International Application No. PCT/EP01/07175, filed Jun. 25, 2001, which designated the United States and was not published in English.

BACKGROUND OF THE INVENTION

FIELD OF THE INVENTION

The invention relates to an oven containing a baking space lighting system that, on manual actuation of a particular manually operated oven element, is switched on or switched off, depending on the form of actuation.

The baking space of an oven is heated through electrical heating units or by gas flames, and sensors measure the temperature. The heating elements and the temperature sensor form a control circuit.

The baking space lighting system contributes to warming. Lighting devices may have a power of up to 150 W or more. In the lower temperature range of the baking space, at approximately 30° C. to 60° C., the baking space lighting system makes a very substantial contribution to the warming of the baking space. In such a temperature range, precise and rapid regulation of the baking space temperature by regulating the baking space heating is possible only with difficulty. To be able to regulate very low temperatures, it is often better to switch off the baking space lighting system altogether. Even without a baking space heating system, the baking space may, depending on the type of appliance, become warmed to over 60° C. simply because the baking space lighting system is switched on.

The baking space lighting system also influences the distribution of heat in the baking space. Bulbs forming part of the baking space lighting system and disposed laterally in the baking space may lie very close to the material to be cooked. The heat radiation from the baking space lighting system may result in increased browning of the material to be cooked.

The baking space is used for the baking, roasting, grilling, steaming, keeping warm, etc., of material to be cooked. To be able to regulate low temperatures, approximately 30° to 60° C., in the prior art, the baking space lighting system is switched off altogether. It would also be possible to regulate such low temperatures using the baking space lighting system exclusively as a heating element. A disadvantage of such a method would be that the user first becomes irritated. It is impossible to understand immediately why the baking space lighting system is switched off in several operating states or even follows a regular cycle.

Further disadvantages are that the user cannot adequately observe the material to be cooked when the baking space lighting system is switched off. Moreover, the baking space lighting system is a very important indication to the user that the oven is in operation and, as a rule, in such a case, also contains material to be cooked. If the baking space lighting system is switched off, it may easily happen that the material to be cooked is forgotten. The normal consequence of this is that the material to be cooked is burnt or at least becomes unpleasant to eat.

SUMMARY OF THE INVENTION

It is accordingly an object of the invention to provide an oven that overcomes the hereinafore-mentioned disadvantages of the heretofore-known devices of this general type and that, even at low temperatures, for example, in the range from 30° C. to 60° C., regulation of the baking space temperature is possible by regulating the baking space heating system, without such regulation being interfered with by the temperature of the baking space lighting system, the user simultaneously being in a position to monitor the material to be cooked for an extended period of time by the light of the switched-on baking space lighting system. Moreover, the invention avoids causing uncertainty to the user as a result of "strange" lighting functions such as, for example, flickering or cyclical light.

With the foregoing and other objects in view, there is provided, in accordance with the invention, an oven, including manually actuated oven elements, a baking space lighting system connected to one of the oven elements, the lighting system respectively being switched on or off dependent upon a form of actuation of the one oven element, a control device connected to the lighting system, the control device programmed to control the lighting system to automatically reduce from a full luminous intensity to a predetermined lower luminous intensity greater than zero unless, after a switching-on of the lighting system, at least one of the oven elements is manually actuated again within a predetermined period of time, but the full luminous intensity of the lighting system being automatically set when the at least one of the oven elements is manually actuated again.

The basis of the invention is that the light in the baking space is not only switched completely on or switched completely off, but either the lighting system is automatically switched to a lower luminous intensity after a predetermined period of time and/or the change in luminous intensity takes place not suddenly but continuously, preferably, in a stepless manner by a dimmer device. In combination with a dimmer device, switching-off and switching-on take place in the form of a slow change of luminous intensity. Intermediate positions are also conceivable, for example, a very weak luminous intensity. The change in luminous intensity takes place in each case over a predetermined period of time and, preferably, in a stepless manner.

Several possible methods of lighting control are conceivable. In a first preferred version, for each type of operation and each temperature, the light is automatically switched down, preferably, dimmed, to a minimum value after a predetermined time, for example, after 10 seconds, during which no operating element or other oven element is actuated. If any operating element or other oven element is actuated, for example, a handle, a button, or the baking space door, the light is automatically set to be brighter for a particular time, for example, for 10 seconds, up to its maximum value.

In a second preferred version, in each type of operation, but only in the critical low-temperature range, for example, in the range between 30° C. and 60° C., and with particular forms of operation, for example, heating or defrosting of material to be cooked, the baking space lighting system is run down to a minimum value. By actuating some operating element or other oven element, the light is run up again to its maximum value for a brief time, for example, 10 seconds.

In accordance with another feature of the invention, the control device has a dimmer device preventing light of the lighting system from being suddenly switched off or reduced to the predetermined low luminous intensity by automatically causing the lighting system to become continuously weaker over a predetermined period of time optically identifiable by a user.

In accordance with a further feature of the invention, the dimmer device is programmed to not suddenly generate light of the lighting system at the full luminous intensity when the lighting system is switched on at one of the oven elements by automatically causing, through the dimmer device, the lighting system to become continuously stronger over a predetermined period of time optically identifiable by a user.

In accordance with an added feature of the invention, the control device is programmed to set the predetermined lower luminous intensity only for a predetermined type of operation of the oven.

In accordance with an additional feature of the invention, the control device is programmed to set the predetermined lower luminous intensity only for a predetermined type of operation of the oven and not in a predetermined other type of operation of the oven.

In accordance with yet another feature of the invention, there is provided a baking space, the control device being programmed to set the predetermined low luminous intensity only when a temperature in the baking space lies within a predetermined temperature.

In accordance with yet a further feature of the invention, there is provided a baking space, the control device being programmed to set the predetermined low luminous intensity only when a temperature in the baking space lies within a predetermined relatively lower temperature range and not when the temperature lies within a predetermined relatively higher temperature range.

In accordance with yet an added feature of the invention, the one of the oven elements causing switching of the lighting system is a baking space door, and opening of the door automatically causes a switching-on of the lighting system and closing of the door automatically causes a switching-off of the lighting system.

With the objects of the invention in view, there is also provided an oven, including manually actuated oven elements, a baking space lighting system connected to one of the oven elements, the lighting system respectively being switched on or off dependent upon a form of actuation of the one oven element, and a control device connected to the lighting system, the control device programmed, after a switching-on of the lighting system, to automatically reduce the lighting system from a full luminous intensity to a predetermined lower luminous intensity greater than zero unless at least one of the oven elements is manually actuated again within a predetermined period of time, and to automatically set the full luminous intensity of the lighting system when the at least one of the oven elements is manually actuated for a second time.

With the objects of the invention in view, there is also provided an oven, including a heating container having an interior, manually actuated oven elements disposed at the heating container, a baking space lighting system at least lighting the interior of the heating container, the lighting system connected to one of the oven elements and respectively being switched on or off dependent upon a form of actuation of the one oven element, and a control device connected to the lighting system, the control device programmed, after a switching-on of the lighting system, to automatically reduce the lighting system from a full luminous intensity to a predetermined lower luminous intensity greater than zero unless at least one of the oven elements is manually actuated again within a predetermined period of time, and to automatically set the full luminous intensity of the lighting system when the at least one of the oven elements is manually actuated for a second time.

With the objects of the invention in view, in an oven having manually actuated oven elements, there is also provided a light system including a baking space lighting system connected to one of the oven elements, the lighting system respectively being switched on or off dependent upon a form of actuation of the one oven element, and a control device connected to the lighting system, the control device programmed, after a switching-on of the lighting system, to automatically reduce the lighting system from a full luminous intensity to a predetermined lower luminous intensity greater than zero unless at least one of the oven elements is manually actuated again within a predetermined period of time, and to automatically set the full luminous intensity of the lighting system when the at least one of the oven elements is manually actuated for a second time.

The invention provides various advantages.

First, with regard to temperature regulation, not only in the upper but also in the lower temperature range, the temperature in the baking space can be regulated in a simple manner by regulating the customary heating elements. The baking space is no longer heated to above the intended level.

Energy is also conserved. By automatically switching down the luminous intensity, energy is saved and the user can still satisfactorily monitor the material to be cooked with reduced illumination. If, in addition, a dimmer function is built in, the user has time to monitor the material to be cooked first with brighter illumination and, then, with reduced illumination, and is informed by the changing luminosity that the oven is functioning as intended.

Operational safety is improved. As a result of the fact that the baking space lighting system is not completely switched off, the user of the oven always remains aware that the oven is switched on. Consequently, he does not forget to turn the oven off in good time.

Further, as a result of the fact that the luminous intensity of the baking space lighting system is run down from maximum power to a predetermined reduced power, is run up, preferably, continuously by a dimmer function and, preferably, in a stepless manner, and is also, preferably, dimmed up, the user is clearly aware that a deliberate operation is taking place behind it. This gives the user the certainty that the oven is functioning as intended, which is obvious even without having to refer to the operating instructions. This prevents the user from interpreting switch-on and switch-off cycles as malfunctioning.

Baking results are improved. Because the running-up and running-down of the luminous intensity of the baking space lighting system can take place at any temperature, in particular, including low intended baking space temperature values, improved distribution of heat in the baking space is possible. The influence of the baking space lighting system on the distribution of heat in the baking space is greatly reduced with reduced luminous intensity.

The bulbs of the baking space lighting system have a longer service life.

Other features that are considered as characteristic for the invention are set forth in the appended claims.

Although the invention is illustrated and described herein as embodied in an oven, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

The FIGURE is a vertical cross-sectional view through an oven according to the invention.

DESCRIPTION OF THE PREFERRED EMBODIMENTS

Referring now to the single FIGURE of the drawing, it is seen, diagrammatically in cross-section, an oven according to the invention with a bulb 2 as a lighting system in a baking space 4. The bulb 2 is switched on and off, as are electrical heating elements 6 of the baking space heating system, by an electrical or electronic control device 8 as a function of the manual operation of manually operated oven elements, for example, a manual operating element 10 for switching on and off the heating elements 6 and for setting the baking space temperature, and also a manual operating element 12 for setting the type of baking space operation, for example, for bottom heating or top heating or for air circulated by a fan 14, and an electrical switch 16, which is actuated by the baking space door 20 when the latter is closed and opened. The baking space door 20 is, thus, a "manually operated oven element." The door 20 is shown in solid lines in a closed position and in broken lines in a partially open position.

The control device 8 is configured to automatically reduce the baking space lighting system 2 from a full luminous intensity to a predetermined lower luminous intensity, which is greater than zero, unless, after it has been switched on, the, or a particular other, oven element 10, 12, 16/20 is manually actuated again within a predetermined period of time, but the full luminous intensity is automatically set again when the, or a particular other, oven element 10, 12, 16/20 is, again, manually actuated, except that the oven element concerned, in the example shown here, the operating element 10 for switching on and off the baking space heating system 6, is, on such further manual actuation, brought into an off position provided thereon for switching off the baking space heating system 6.

At least the embodiments set forth in the following text are conceivable. The baking space lighting system 2 can always be automatically switched on when one of the oven elements 10, 12 or 16/20 is actuated, regardless of whether the baking space heating system 6 on the oven element or operating element 10 is switched on or not. In accordance with another embodiment, it is possible that the baking space lighting system 2 may not be switched on, or may be switched off, by the type-of-operation operating element 12 and the baking space door 20 or its switch 16 if the baking space heating system 6 is not switched on at the operating element 10 provided for such a purpose. The foregoing list does not exclude further embodiments.

According to a preferred embodiment of the invention, the control device 8 contains a dimmer device 22, whereby the light of the baking space lighting system 6, when it is switched off, is not, as the case may be, suddenly extinguished or suddenly reduced to the predetermined low luminous intensity. Rather, the light is set to become automatically continuously weaker, preferably, in a stepless manner, over a predetermined, relatively long period of time that can be identified by the user.

Moreover, the dimmer device 22 may be configured so that the light of the baking space lighting system 6, when switched on at one of the oven elements 10, 12, 16/20, does not in each case suddenly reach full luminous intensity but, rather, is set by the dimmer device to become automatically continuously stronger, preferably, in a stepless manner, over a predetermined, relatively long period of time that can be optically identified by the user.

Moreover, the control device 8 may be configured so that it sets the predetermined low luminous intensity only when the temperature in the baking space 4 lies within a predetermined low temperature range, for example, between 30° C. and 60° C., but not when it lies within a predetermined higher temperature range lying above the latter.

We claim:

1. An oven, comprising:

manually actuated oven elements;

a baking space lighting system connected to one of said oven elements, said lighting system respectively being switched on or off dependent upon a form of actuation of said one oven element;

a control device connected to said lighting system, said control device programmed to control said lighting system to automatically reduce from a full luminous intensity to a predetermined lower luminous intensity greater than zero unless, after a switching-on of said lighting system, at least one of said oven elements is manually actuated again within a predetermined period of time, but said full luminous intensity of said lighting system being automatically set when said at least one of said oven elements is manually actuated again.

2. The oven according to claim 1, wherein said control device has a dimmer device preventing light of said lighting system from being suddenly switched off by automatically causing said lighting system to become continuously weaker over a predetermined period of time optically identifiable by a user.

3. The oven according to claim 2, wherein said dimmer device is programmed to not suddenly generate light of said lighting system at said full luminous intensity when said lighting system is switched on at one of said oven elements by automatically causing, through said dimmer device, said lighting system to become continuously stronger over a predetermined period of time optically identifiable by a user.

4. The oven according to claim 1, wherein said control device has a dimmer device preventing light of said lighting system from being suddenly reduced to said predetermined low luminous intensity by automatically causing said lighting system to become continuously weaker over a predetermined period of time optically identifiable by a user.

5. The oven according to claim 4, wherein said dimmer device is programmed to not suddenly generate light of said lighting system at said full luminous intensity when said lighting system is switched on at one of said oven elements by automatically causing, through said dimmer device, said lighting system to become continuously stronger over a predetermined period of time optically identifiable by a user.

6. The oven according to claim 1, wherein said control device is programmed to set said predetermined lower luminous intensity only for a predetermined type of operation of the oven.

7. The oven according to claim 1, wherein said control device is programmed to set said predetermined lower luminous intensity only for a predetermined type of operation of the oven and not in a predetermined other type of operation of the oven.

8. The oven according to claim 1, including a baking space, said control device being programmed to set said predetermined low luminous intensity only when a temperature in said baking space lies within a predetermined temperature.

9. The oven according to claim 1, including a baking space, said control device being programmed to set said predetermined low luminous intensity only when a temperature in said baking space lies within a predetermined relatively lower temperature range and not when said temperature lies within a predetermined relatively higher temperature range.

10. The oven according to claim 1, wherein:

said one of said oven elements causing switching of said lighting system is a baking space door; and opening of said door automatically causes a switching-on of said lighting system and closing of said door automatically causes a switching-off of said lighting system.

11. An oven, comprising:

manually actuated oven elements;

a baking space lighting system connected to one of said oven elements, said lighting system respectively being switched on or off dependent upon a form of actuation of said one oven element; and a control device connected to said lighting system, said control device programmed:

after a switching-on of said lighting system, to automatically reduce said lighting system from a full luminous intensity to a predetermined lower luminous intensity greater than zero unless at least one of said oven elements is manually actuated again within a predetermined period of time; and to automatically set said full luminous intensity of said lighting system when said at least one of said oven elements is manually actuated for a second time.

12. An oven, comprising:

a heating container having an interior;

manually actuated oven elements disposed at said heating container;

a baking space lighting system at least lighting said interior of said heating container, said lighting system connected to one of said oven elements and respectively being switched on or off dependent upon a form of actuation of said one oven element; and a control device connected to said lighting system, said control device programmed:

after a switching-on of said lighting system, to automatically reduce said lighting system from a full luminous intensity to a predetermined lower luminous intensity greater than zero unless at least one of said oven elements is manually actuated again within a predetermined period of time; and to automatically set said full luminous intensity of said lighting system when said at least one of said oven elements is manually actuated for a second time.

13. In an oven having manually actuated oven elements, a light system comprising:

a baking space lighting system connected to one of said oven elements, said lighting system respectively being switched on or off dependent upon a form of actuation of said one oven element; and a control device connected to said lighting system, said control device programmed:

after a switching-on of said lighting system, to automatically reduce said lighting system from a full luminous intensity to a predetermined lower luminous intensity greater than zero unless at least one of said oven elements is manually actuated again within a predetermined period of time; and to automatically set said full luminous intensity of said lighting system when said at least one of said oven elements is manually actuated for a second time.

* * * * *